United States Patent [19]

Hope et al.

[11] 4,239,367

[45] Dec. 16, 1980

[54] CONTINUOUS-BAND WEB TRANSPORT

[76] Inventors: Henry F. Hope, 3192 Huntingdon Rd., Huntingdon Valley, Pa. 19006; Stephen F. Hope, Wynadotte Rd., Willow Grove, Pa. 19090

[21] Appl. No.: 20,448

[22] Filed: Mar. 14, 1979

[51] Int. Cl.[3] ..... G03D 3/13

[52] U.S. Cl. ..... 354/319; 354/321; 354/322; 156/157; 156/502; 156/510; 226/92

[58] Field of Search ..... 156/157, 250, 502, 505, 156/510, 522; 242/56 R; 355/27, 28; 226/91, 92, 93, 96; 134/64 P, 122 P; 354/312, 313, 314, 316, 319, 320, 321, 322, 340, 344, 345

[56] References Cited

U.S. PATENT DOCUMENTS

| | | | |
|---|---|---|---|
| 2,928,329 | 3/1960 | Limbach | 226/92 |
| 3,107,193 | 10/1963 | DeNeui et al. | 156/527 |
| 3,409,157 | 11/1968 | Lull | 414/622 |
| 3,462,054 | 8/1969 | Foor | 352/235 |
| 3,586,571 | 6/1971 | Szakacs | 156/502 |
| 3,609,805 | 10/1971 | Fritsch | 226/172 |
| 3,610,501 | 10/1971 | Wolfelsperger | 226/172 |
| 3,622,425 | 11/1971 | Savarick et al. | 156/505 |
| 3,640,204 | 2/1972 | Gordon | 354/318 |
| 3,656,676 | 4/1972 | Hope et al. | 226/92 |
| 3,717,057 | 2/1973 | Takimoto | 156/510 |
| 3,727,815 | 4/1973 | Schwartz | 226/93 |
| 3,737,358 | 6/1973 | King | 156/502 |
| 3,748,208 | 7/1973 | Schnellmann | 156/545 |
| 3,762,300 | 10/1973 | Hart et al. | 354/312 |
| 3,767,513 | 10/1973 | Gnage et al. | 156/344 |
| 3,779,837 | 12/1973 | Zahn et al. | 156/505 |
| 3,939,026 | 2/1976 | Petry et al. | 156/545 |
| 4,017,182 | 4/1977 | Robbins | 352/183 |
| 4,046,615 | 9/1977 | Jansen | 352/183 |
| 4,055,289 | 10/1977 | Kaiser et al. | 226/92 |
| 4,065,042 | 12/1977 | Zielinski | 354/321 |
| 4,067,035 | 1/1978 | Plursch et al. | 354/313 |
| 4,072,260 | 2/1978 | Dove | 354/345 |
| 4,094,726 | 6/1978 | Hujer et al. | 156/502 |
| 4,099,193 | 7/1978 | Leuchter et al. | 354/321 |
| 4,110,774 | 8/1978 | Krehbiel et al. | 354/345 |
| 4,140,383 | 2/1979 | Schmidt | 354/316 |

*Primary Examiner*—L. T. Hix
*Assistant Examiner*—Alan Mathews
*Attorney, Agent, or Firm*—Weiser, Stapler & Spivak

[57] ABSTRACT

Economical and trouble-free operation of automatic processing machines for webs such as photographic film strips and paper is achieved.

A leader tape is threaded through the processing machine. The leading end of a strip of film or paper to be processed is automatically attached to this tape for transport through the machine. Behind the attachment point of the strip to the transport tape, the tape is automatically severed, but is later automatically reattached to the trailing end of the strip. This operation is repeated for consecutive film strips or papers to be processed through the machine.

In this way, an uninterrupted band of either tape or web is always in the machine. This permits simple machine construction, with supports for the web preferably only at its turnabout locations, and with powered drive preferably only at the exit from the machine. Yet, even long webs of film or paper can be automatically processed without wasteful leader tape consumption.

18 Claims, 3 Drawing Figures

CONTINUOUS-BAND WEB TRANSPORT

BACKGROUND OF THE INVENTION

This invention relates generally to the field of photographic film processing, and more particularly to an improved means for transporting the strips of film to be developed through the several processing tanks of an automatic film developing machine.

Various arrangements are known for carrying out this film transporting.

One such arrangement involves strings of transport rollers, which are positioned along the generally sinusoidal path followed by the film through the various processing baths, and which are rotated to propel the film along its path. Typical arrangements of this type was disclosed in our U.S. Pat. Nos. 3,989,176 and 4,079,635.

Other arrangements are those disclosed in our prior U.S. Patent Applications Ser. No. 006,075 filed Jan. 24, 1979, and Ser. No. 016,390 filed Mar. 1, 1979. These use a tape attached to the edge of the film and extending lengthwise through the machine, generally parallel to and alongside of the film. This tape transports the film through the processing machine.

The foregoing arrangements are all eminently satisfactory for their intended purposes, but this does not mean that even they are not susceptible of further improvement.

Those arrangements which are disclosed in our prior issued patents require substantial numbers of transport rollers. This makes them somewhat complex, from the standpoint of both initial construction and subsequent maintenance. It also creates some possiblility, however slight, of marring the delicate emulsions which are present on the webs during processing.

Those arrangements which are disclosed in our still-pending prior patent applications utilize transport tapes which are positioned alongside the webs, as the latter are transported through the machine. When these webs are long (e.g. film strips 100 feet or more in length), the corresponding accompanying lengths of tape raise the cost of the processing operations. Moreover, the presence of web and tape side-by-side in the machine does create some slight possibility of mechanical interference by the tape with the unhindered processing of the web by the processing media within the machine.

SUMMARY OF THE INVENTION

The present invention provides a new technique for using a transport tape to cooperate with the strips of film or paper to be processed in an automatic processing machine.

To this end, the transport tape is initially threaded into the processing machine, through which this tape then extends along the same path to be followed by the strips which are subsequently to be processed through the machine.

This tape preferably forms part of a much longer roll of tape, mounted at the inlet to the machine. The portion threaded through the machine has been unwound from this roll, but without having been severed from the remainder of the roll.

when a strip, e.g. of film, is to be processed, the machine is set in motion, so that the tape moves through the machine, progressively unwinding from the roll.

The leading end portion of the film strip is also brought close to the inlet of the machine, in such a manner that it extends parallel to the path of the tape entering the machine, and with one face of the film positioned adjacent to one face of the tape.

These adjacent portions of the tape and the leading end of the film are then automatically attached to each other, e.g. by being stapled together, and the tape is automatically severed from the remainder of the roll at a point "behind" the location of the attachment between tape and film, i.e, in the direction toward the tape roll from the attachment location.

In this way, there is formed a continuous band, consisting of the portion of the tape "ahead" of the attachment location between tape and film, followed by the film strip itself. This continuous band of tape, followed by film, then proceeds through the processing machine.

When, as a result of such movement of the film through the processing machine, the trailing end of this film approaches the inlet to the machine, this trailing end and the leading end of the (severed) tape which had remained behind as part of the tape roll are again automatically brought close to each other so that their respective faces are adjacent to each other. This trailing end of the film, and the adjacent leading end of the tape are automatically reattached e.g. again by stapling.

Thus, to the prior continuous band of tape, followed by film, there is now added a further continuous band portion of tape, following the film.

Similarly, the leading end of the next film strip is then attached to this further portion of tape, the tape is again severed but reattached at the trailing end of the film, and so on over and over for successive film strips.

Thus a continuous band, consisting of alternate tape segments and film strips proceeds through the processing machine.

This continuity facilitates the use of a small number of transport rollers or pulleys within the machine, preferably only at the inflexion points in the processing path. At the same time, it minimizes the consumption of tape, and eliminates all possible mechanical interference between tape and film.

All of the key operations are performed by automated means, thereby eliminating burdensome hand-labor, and also reducing the possibility of damage to the delicate photosensitive emulsions which can come from handling of film or paper.

Accordingly, it is an object of this invention to provide an improvement in automatic web processing machinery utilizing a transport tape in conjunction with the web strips to be processed.

It is another object to provide an improved technique for automatically combining tapes and webs for such transport.

It is another object to provide such an improved technique which reduces the consumption of tape.

It is still another object to provide such a technique which averts mechanical interference between tape and web.

It is still another object to provide such a technique which averts interference by the tape with the intended processing of the web in the machine.

It is still another object to provide such a technique which reduces manual operations and possible damage attributable to handling.

BRIEF DESCRIPTION OF THE DRAWINGS

For further details, reference is made to the discussion which follows, taken in conjunction with the accompanying drawings wherein.

The same reference numerals designate similar elements in the several figures.

DESCRIPTION OF THE PREFERRED EMBODIMENT OF THE INVENTION

Figure 1:
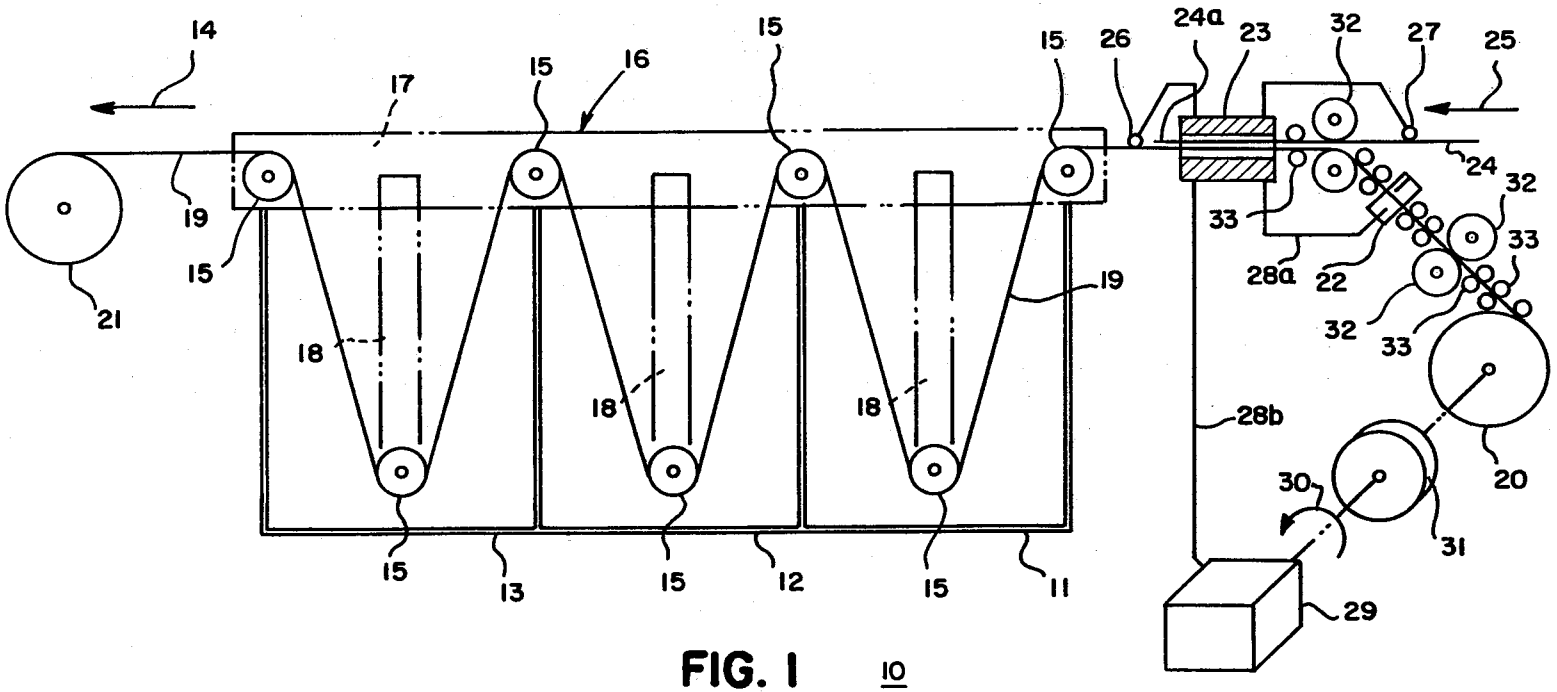
FIG. 1 is a diagrammatic overall illustration of a film processing machine which utilizes a tape and film transport arrangement embodying this invention.

Although specific terms are used in the following description, these are intended to refer only to the particular structure selected for illustration in the drawings, and are not intended to define or limit the scope of the invention.

Referring now to the drawings, there is shown in FIG. 1 a film processing machine 10, diagrammatically illustrated in side elevation, which may include three film processing tanks 11, 12 and 13 through which the web to be processed is to be transported in the direction indicated by arrow 14.

This transporting through machine 10 is performed by a plurality of rollers or pulleys 15, appropriately positioned with respect to processing tanks 10, 11 and 12.

Preferably, these rollers or pulleys 15 are provided only at bends in the path of the material through machine 10, e.g. at the inlet and exit of each processing tank and at the bottoms of these tanks.

The rollers 15 may be mounted on a frame 16 comprising a horizontal beam 17 supporting the pulleys at the tops of the tanks and vertical extensions 18 supporting the pulleys at the bottom of the tanks.

In FIG. 1, there is shown extending through the tanks 11, 12 and 13 of processing machine 10, a leader tape 19 which comes from a storage roll 20 positioned appropriately in relation to the inlet to machine 10 and which terminates upon a take-up reel 21 positioned at the exit end of the machine.

Before reaching the first roller 15 at the top of the first processing tank 11, the leader tape 19 passes in succession through a power operated mechanism 22 which is so constructed as to be capable of severing the tape passing through that mechanism on command. The tape 19 also passes through another power operated mechanism 23 which is so constructed as to, also on command, put a fastening means, such as a staple through tape 19 and through any other material adjacent to tape 19 within the confines of mechanism 23.

Also extending into mechanism 23 there is shown in FIG. 1, the leading portion of a film strip 24 to be processed by machine 10, which leading portion has been introduced from the right, i.e., in the direction of arrow 25.

Microswitches 26 and 27 are provided as shown in FIG. 1 and control connections 28*a* and 28*b* extend, respectively, from mechanism 23 to severing mechanism 22 and also to a motor 29. This motor is energizable under the command received through control connection 28*b* from mechanism 23 so as to rotate storage roll 20 in the direction of arrow 30 through an overrunning, one way clutch 31.

In addition, guide rollers 32 and 33 are provided, both between storage roll 20 and severing mechanism 22, and between severing mechanism 22 and stapling mechanism 23.

In operation, the leader tape 19 has previously been threaded through machine 10 and is being propelled through that machine in the direction to arrow 14, unwinding while doing so from storage roll 20 and again winding up upon take up reel 21.

The film 24 to be processed has been introduced into the stapling mechanism 23 where it essentially rests upon tape 19 proceeding through that stapling mechanism. This film 24 is introduced into the stapling mechanism far enough so that the leading edge 24*a* of the film 24 ultimately contacts microswitch 26. This causes the stapling mechanism 23 to operate and to attach the leading end portion of film 24 to the underlying portion of tape 19 within the stapling mechanism 23. At the same time, there is transmitted through control connection 28*a* a command to severing mechanism 22 to cut tape 19 at the point at which it passes through that severing mechanism.

Thereafter, the tape 19 which is already within machine 10 continues to be transported through that machine, but now there is attached to its severed, trailing end, the film 24 to be processed through the insertion of a staple within stapling mechanism 23.

Figure 2:
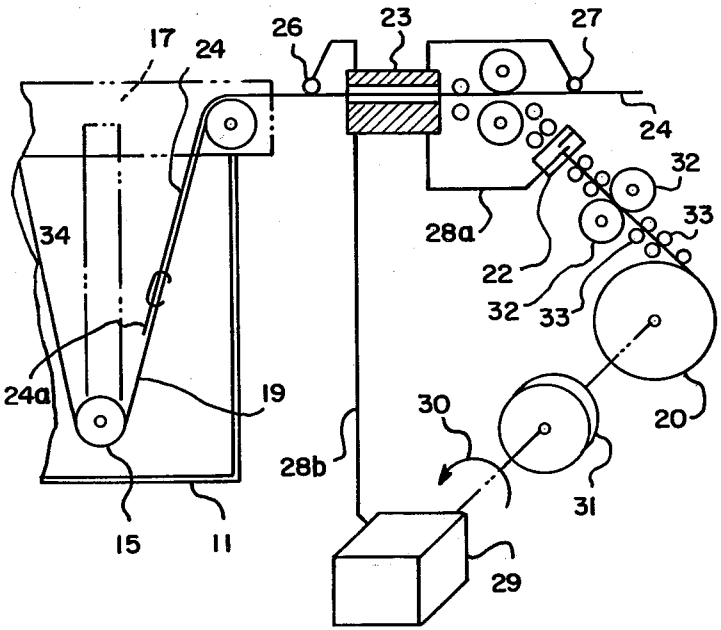
FIG. 2 is a diagrammatic illustration of a fragment of the arrangement of FIG. 1, showing that arrangement at another stage of its operating cycle.

This next stage in the operation of the machine is particularly evident from FIG. 2 which shows the apparatus to the right of the machine in FIG. 1 and also a fragment of the first of its processing tanks 11. In this FIG. 2, it will be seen that there is proceeding into this first processing tank 11 the leading portion of film strip 24 which has previously been attached to the now severed trailing end portion of tape 19 by a staple 34 diagrammatically indicated as connecting the tape and film in FIG. 2 of the drawings.

On the other hand, the remainder of tape 19 is now stationary, being no longer subject to transportation by having been severed at mechanism 22 from the portion of the tape 19 which is continuing to proceed through machine 10.

Figure 3:
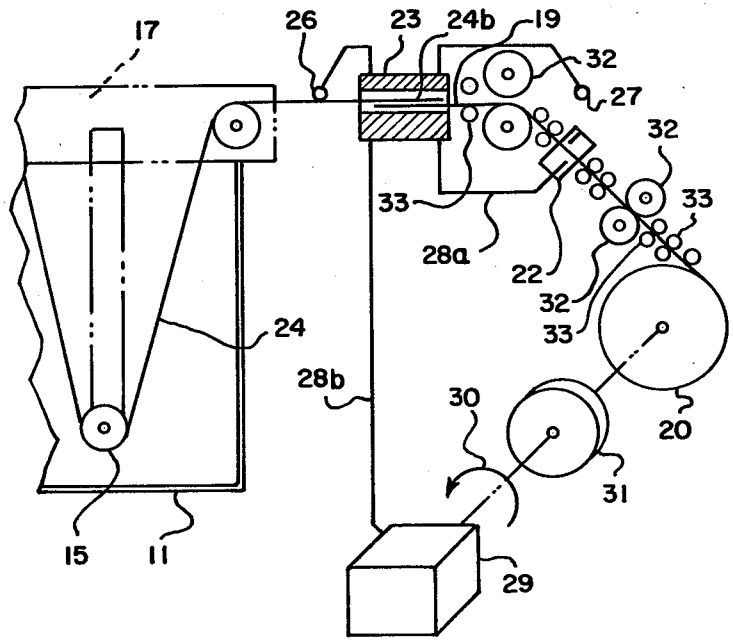
FIG. 3 shows the same fragment as FIG. 2, but at a third stage in its operation.

This condition continues so long as the film strip 24 is proceeding through the machine 10. What happens when the trailing end portion 24*b* of the film strip 10 approaches the inlet to machine 10 is diagrammatically shown in FIG. 3 of the drawings. There the trailing end 24*b* of film strip 24 is shown as having already passed microswitch 27 positioned ahead of the inlet to stapling mechanism 23. Such passage of the trailing end 24*b* of film 24 is sensed by microswitch 27 and actuates, through control connection 28*b*, the motor 29 which then causes rotation of storage roll 20 via clutch 31 in the direction of arrow 30. This rotation of roll 20 causes the tape 19 extending toward severing mechanism 22 from roll 20 to advance into the stapling mechanism 23, where it is again shown adjacent to the trailing portion 24*b* of film 24. After a timed interval, long enough to permit this tape 19 to assume the position illustrated in FIG. 3, stapling mechanism 23 again operates and reattaches the leading end portion of tape 19 to the trailing end portion 24*b* of film strip 24.

Thereafter, the film strip 24 with its leader tape 19 reattached to the end continues through machine 10, through which it is once again followed by the leader tape 19.

At this point, the next film strip 24 can be brought into the position illustrated in FIG. 1, and the entire sequence of stages described above can be repeated.

The operation of motor 29 lasts only as long as the timed interval until stapling of leader tape 19 to the trailing end portion 24*b* of film strip 24. Both operations are therefore timed to the same length. The clutch mechanism 31 permits the motor 29, when actuated as described above, to cause the storage roll 20 to rotate and to advance the tape 19 as described above. When motor 29 is stationary, this clutch, being of the overrunning type, nevertheless permits roll 20 to continue to rotate in the direction of arrow 30, so that the leader tape 19 can continue to be unwound from its storage roll 20 for transport into and through machine 10.

Throughout the operating stages described above, the tape and film are guided along the respective paths leading into stapling mechanism 23 by means of guide rollers 32, 33, positioned along that path.

Referring again to FIG. 1, after leaving the final processing stage of machine 10, film strip 24 may be again separated from leader tape 19 or, alternatively, the continuous band formed by alternate segments of leader tape 19 and film strips 24 may be simply wound up on take up reel 21.

The propulsion for tape and film through machine 10 may be provided either by a mechanism which rotates take-up reel 21, thereby creating a movement in the direction of arrow 14 which is transmitted back throughout the entire system. Alternatively, if this is considered to place too great a strain on the material being transported through the machine, supplemental drive may be provided by also applying motive power to one or more of rollers 15.

It will be understood that many specific variations of the apparatus described and illustrated above are possible within the scope of the invention.

For example, it is not essential that the attachment of film to leader tape be by means of staples. Rivets, stitching, or other suitable attaching means may also be employed.

The material from which these attachments are made should, of course, be preferably inert in relation to the processing media to which the film is exposed within machine 10.

The leader tape 19 itself, may be made of a variety of materials, for example, substantially any plastic (synthetic polymer) such as polyethylene is quite suitable. However, non-plastic material can also be used, such as a cellulosic web which may even be paper and which is inert and resistant to the chemicals or other operations which are carried out during transport through machine 10.

As for dimensions, the leader tape 19 is generally of a width which is no greater than, and may even be narrower than that of film 24. For example, for the processing of films such as those used in conventional photography, e.g., 35 millimeter film, the leader tape 19 may be approximately one-half inch wide and ten mils thick.

It will be also understood that the illustrations provided in the drawings of this application are not to scale. Likewise, it will be understood that separations, such as appear in the drawings between tape 19 and adjacent portions of film strip 24, are not physically present in the embodiments of the invention. These separations have been diagrammatically shown in the drawings only to make visible the intended spatial relationships between them.

Also, the film strip 24 and leader tape 19 are preferably juxtaposed in such a manner that it is the side or face of film strip 24 which is not coated with photosensitive emulsion that is in contact with the adjoining tape 19.

We claim:

1. The method of processing webs such as photographic film strips or papers through an automatic processing machine, comprising the steps of threading a leader tape through the machine, transporting the tape through the machine, automatically attaching the leading end portion of a web to be processed to the tape at the inlet of the machine, while the tape is being transported through the machine, automatically severing the tape at a point such that the portion of the tape which has been threaded through the machine remains attached to the web, the severing step being performed while the tape is being transported through the machine, transporting the tape followed by the web through the machine, and automatically attaching the portion of the leader tape which was severed from the web to the trailing end portion of the web when that trailing end portion reaches the inlet of the machine.

2. The method of claim 1 further comprising repeating said steps of attaching, severing, transporting and attaching at least once using a second web.

3. The method of claim 2 further comprising repeating said steps a plurality of times using different webs.

4. The method of claim 3 wherein the transporting through the machine is along a path defined by a plurality of transport rollers positioned at the inflection points of the path.

5. The method of claim 4 wherein the tape followed by the web is taken up on a take-up reel at the exit of the machine.

6. The method of claim 5 wherein the transporting through the machine is activated by rotating the take-up reel.

7. The method of claim 5 wherein the transporting through the machine is activated by rotating the transport rollers.

8. In a system for processing webs such as photographic film strips or papers through an automatic processing machine:

a leader tape adapted to be threaded through the machine, means for automatically attaching to a portion of the threaded tape, which is at the inlet to the machine, the leading end portion of the web to be processed, said automatic attaching means being adapted for operation while the leader tape is moving through the machine, means for automatically severing the portion of the tape behind the attachment of the web from the portion which is ahead of the attachment and which extends into the machine, means for transporting the leader portion, which is ahead of the web, followed by the attached web through the machine, whereby the web is processed, and means for automatically attaching to the trailing end of the web, when that reaches the inlet to the machine, the leading end of the portion of the tape behind the attachment of the web for following the web into and through the machine.

9. The system of claim 8 wherein the tape is substantially in line with the web at the attachment location.

10. The system of claim 9 wherein the tape is initially a continuous band substantially longer than required to thread through the machine.

11. The system of claim 10 wherein the initial tape band is many times longer than that required to thread through the machine.

12. The system of claim 11 wherein the tape is stored on a roll and adapted to be unwound from that roll for threading into the machine.

13. In a system for processing webs such as photographic film strips or papers through an automatic processing machine:

a leader tape adapted to be threaded through the machine, means for automatically attaching to a portion of the threaded tape, which is at the inlet to the machine, the leading end portion of the web to be processed, means for automatically severing the portion of the tape behind the attachment of the web from a portion which is ahead of the attachment and which extends into the machine, means for transporting the leader portion, which is ahead of the web, followed by the attached web, through the machine, whereby the web is processed, and means for automatically attaching to the trailing end of the web, when that reaches the inlet to the machine, the leading end of the portion of the tape behind the attachment of the web for following the web into and through the machine, the tape being substantially in line with the web at the attachment location, the tape being initially a continuous band many times longer than that required to thread through the machine, the tape being stored on a roll and adapted to be unwound from that roll for threading into the machine, and the system further comprising means for sensing the proximity of the web leading end to the tape at the inlet of the machine, the web-to-tape attaching means and the tape severing means being responsive to said sensing to perform the attaching and the severing.

14. The system of claim 13 further comprising means for sensing the proximity of the web trailing end to the inlet of the machine.

15. The system of claim 14 wherein the attaching means is responsive to the trailing end sensing means to perform the attaching to the trailing end of the tape.

16. The system of claim 15 wherein the attaching means comprises means for automatically advancing the leading end of the previously severed tape into engagement with the web trailing end portion.

17. The system of claim 16 wherein the advancing means includes an intermittently operable motor coupled to the tape roll and a switch mechanism which permits the tape roll to overrun the motor drive.

18. The system of claim 17 wherein the processing machine has transport rollers at the inflexions of the tape and web processed thereby.

* * * * *